US007559106B1

(12) United States Patent
Crousore et al.

(10) Patent No.: US 7,559,106 B1
(45) Date of Patent: Jul. 14, 2009

(54) DYNAMIC PRESSURE RELIEVING MATTRESSES

(75) Inventors: Robert Crousore, Carlsbad, CA (US); Shawn Lipman, Calabasas, CA (US)

(73) Assignee: Scott Technology LLC, Oxford, CT (US)

( * ) Notice: Subject to any disclaimer, the term of this patent is extended or adjusted under 35 U.S.C. 154(b) by 0 days.

(21) Appl. No.: 11/615,707

(22) Filed: Dec. 22, 2006

Related U.S. Application Data

(60) Provisional application No. 60/754,015, filed on Dec. 24, 2005.

(51) Int. Cl.
*A47C 27/16* (2006.01)
*A47C 27/15* (2006.01)
*A47C 27/22* (2006.01)

(52) U.S. Cl. ..... 5/740; 5/953; 5/736; 5/727

(58) Field of Classification Search ..... 5/740, 5/953, 655.9, 727, 736, 730–732, 739, 944, 5/737, 738, 724, 652.1
See application file for complete search history.

(56) References Cited

U.S. PATENT DOCUMENTS 2,785,739 A * 3/1957 McGregor, Jr. et al. ..... 267/145
3,109,182 A * 11/1963 Doak ..... 5/636
3,222,697 A * 12/1965 Scheermesser ..... 428/160
3,283,346 A * 11/1966 Marsh et al. ..... 428/101
3,403,414 A * 10/1968 Unger ..... 5/636
3,974,532 A * 8/1976 Ecchuya ..... 5/724
4,042,988 A * 8/1977 Holliday ..... 5/710
4,047,254 A * 9/1977 Hamasu ..... 5/740
4,207,636 A * 6/1980 Ceriani ..... 428/101
4,383,342 A * 5/1983 Forster ..... 5/731
4,445,241 A * 5/1984 Ender et al. ..... 5/652.1
4,606,088 A * 8/1986 Michaelsen et al. ..... 5/636
4,665,573 A * 5/1987 Fiore ..... 5/731
4,713,854 A * 12/1987 Graebe ..... 5/652
4,726,087 A * 2/1988 Schaefer et al. ..... 5/636
4,741,058 A * 5/1988 Williams et al. ..... 5/691
4,799,275 A * 1/1989 Sprague, Jr. ..... 5/652
4,809,374 A * 3/1989 Saviez ..... 5/420
4,862,538 A * 9/1989 Spann et al. ..... 5/730
4,901,387 A * 2/1990 Luke ..... 5/730
4,916,765 A * 4/1990 Castronovo, Jr. ..... 5/640
4,930,173 A * 6/1990 Woller ..... 297/452.48
4,955,095 A * 9/1990 Gerrick ..... 5/691
4,967,433 A * 11/1990 Neal ..... 5/655.9
5,025,519 A * 6/1991 Spann et al. ..... 5/730
5,160,785 A * 11/1992 Davidson, Jr. ..... 428/316.6
5,252,278 A * 10/1993 Spann et al. ..... 264/138

(Continued)

FOREIGN PATENT DOCUMENTS

FR 2646772 A1 * 11/1990

(Continued)

*Primary Examiner*—Robert G Santos
(74) *Attorney, Agent, or Firm*—MacMillan, Sobanski & Todd, LLC

(57) ABSTRACT

An ergonomic passive support surface comprising a set of foam support elements and a pressure equalization layer which is preferably a fibrous fill material layer or foam layer. Pressure distribution is controlled by the characteristics and shape of a foam material. Preferably, the foam material is provided as a set of transverse oriented cylindrical sections, selected for desired support characteristics.

20 Claims, 10 Drawing Sheets

U.S. PATENT DOCUMENTS 5,265,295 A * 11/1993 Sturgis ..... 5/655.9
5,317,768 A * 6/1994 Klancnik ..... 5/736
5,488,746 A * 2/1996 Hudson ..... 5/500
5,533,218 A * 7/1996 Fahy ..... 5/636
5,580,504 A * 12/1996 Spann et al. ..... 264/138
5,636,397 A * 6/1997 Boyd et al. ..... 5/739
5,671,492 A * 9/1997 Simon ..... 5/722
6,212,720 B1 * 4/2001 Antinori et al. ..... 5/727
6,223,369 B1 * 5/2001 Maier et al. ..... 5/713
6,256,822 B1 * 7/2001 Weston et al. ..... 5/732
6,442,780 B1 * 9/2002 Phillips et al. ..... 5/730
6,578,220 B1 * 6/2003 Smith ..... 5/740
6,668,409 B1 * 12/2003 Blumer ..... 5/740
6,782,575 B1 * 8/2004 Robinson ..... 5/740
6,848,138 B1 * 2/2005 Maier et al. ..... 5/730
6,874,185 B1 * 4/2005 Phillips et al. ..... 5/730
7,100,229 B2 * 9/2006 O'Reagan ..... 5/736
7,293,311 B2 * 11/2007 Baker ..... 5/721
7,444,707 B2 * 11/2008 O'Reagan ..... 5/736
7,509,698 B2 * 3/2009 Poulos ..... 5/710
2005/0044635 A1 * 3/2005 O'Reagan ..... 5/736
2005/0076448 A1 * 4/2005 O'Reagan ..... 5/736
2008/0256706 A1 * 10/2008 Larsen ..... 5/425

FOREIGN PATENT DOCUMENTS

GB 2197785 A * 6/1988

* cited by examiner

DYNAMIC PRESSURE RELIEVING MATTRESSES

FIELD OF THE INVENTION

The present invention relates to the field of mattresses, and more particularly to mattresses which relieve excess pressure.

BACKGROUND OF THE INVENTION

There are many different types of mattresses which relieve pressure, and which include foam elements or foam-filled pneumatic chambers useful for pressure relieving patient support surfaces.

SUMMARY OF THE INVENTION

The present invention relates to a set of designs incorporating a foam support, which acts below a fiber layer, see, e.g., U.S. Pat. No. 6,946,196, expressly incorporated herein by reference, or the like, to distribute the patient's weight over the mattress to avoid pressure injury or necrosis.

According to this embodiment, a non-powered pressure relieving patient support surface is provided which in a preferred embodiment, comprises a fluid, stain and odor resistant, anti-bacterial, anti-fungal top cover; a set of foam elements, e.g., closed cell polyurethane foam, preferably hemicylindrically shaped, providing a set of zones to provide proper support for various parts of the body; and a fibrous material which interfaces the cover with the foam elements, to evenly distribute the patients weight. The foam elements are preferably longitudinally oriented, and provided in sequential adjacent groups, arranged in longitudinal series each group forming a zone intended for a body region, such as head, seat, and foot. The foam elements of each zone, for example, may differ in the diameter of the foam cylinder and the respective portion thereof, the firmness of the foam, and the longitudinal compaction.

It is thus appreciated that a variety of parameters of the foam may be varied to achieve the desired firmness, for example the closed-cell or open cell nature, the density of the foam, the tapering of the foam from base, which generally forms a contiguous foam region, and the top (beneath the fiber layer), which is discontinuous, having gaps between the respective foam elements, and the number and size of the elements, which are typically longitudinally disposed within a zone.

A relatively firm foam edge is optionally provided, to give increased support (e.g., the ProCair VR™), such that edge of the mattress does not compress as easily, thus supporting a person sitting at the edge of the bed, and reducing the tendency to roll out of the bed.

The construction and method of operation of the invention will be best understood from the following description of specific embodiments when read in connection with the accompanying drawings.

DETAILED DESCRIPTION OF THE PREFERRED EMBODIMENTS

Now, the exemplary mattress design will be described in detail with reference to the accompanying drawings.

Figure 1:
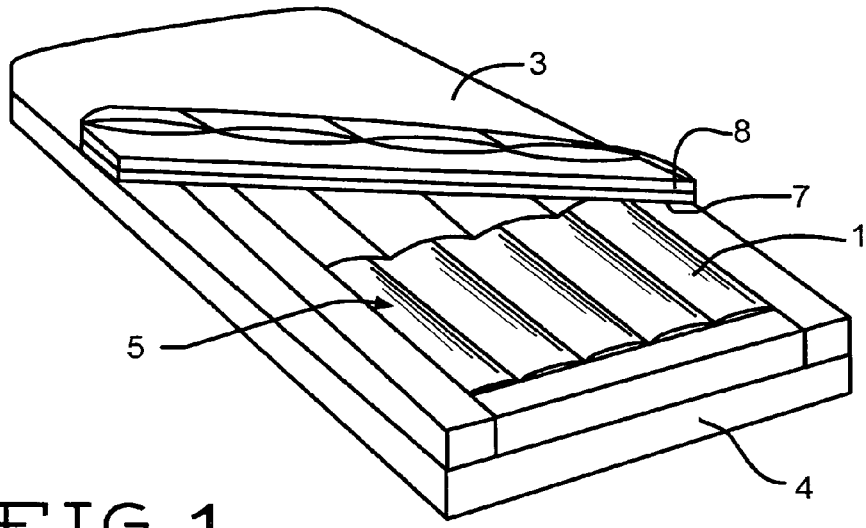
FIG. 1 shows a partial cutaway perspective view of an exemplary mattress design.
Figure 3A:
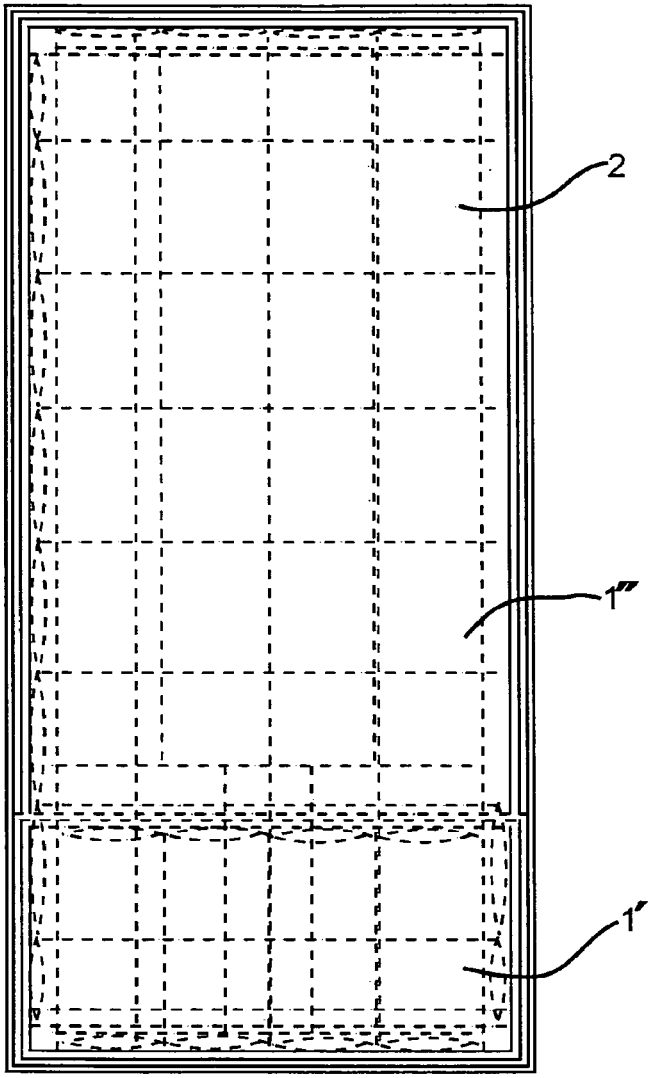
FIGS. 3A, 3B and 3C show, respectively, a top, side and end view of the mattress, showing the various sections of the mattress and their respective foam elements.
Figure 3B:
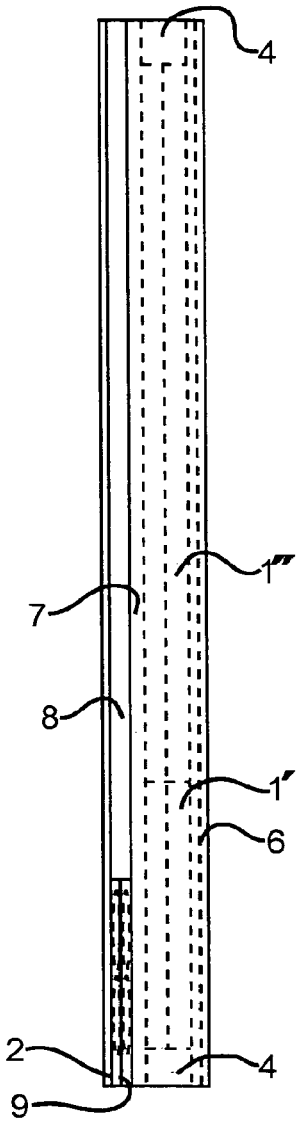
Figure 3C:
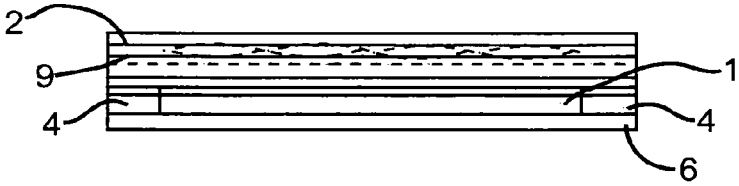
Figure 4:
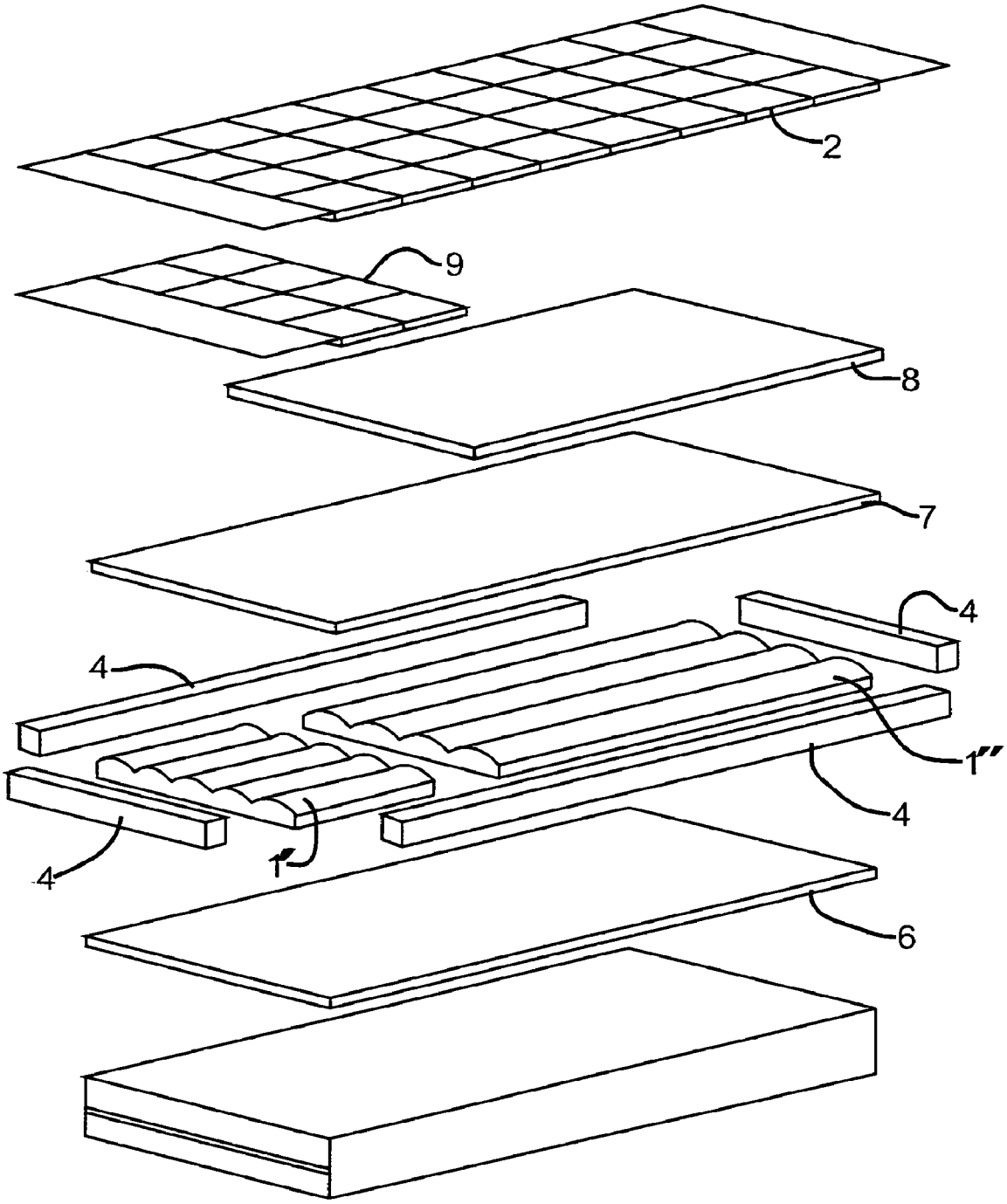
FIG. 4 shows an exploded view of the mattress design.
Figure 5A:
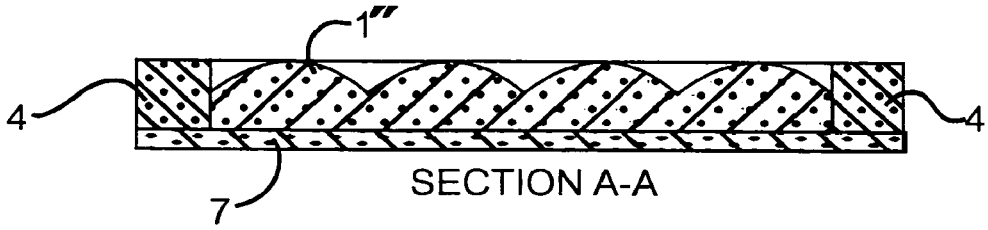
FIGS. 5A, 5B, 5C, 5D and 5E show, respectively, a top, section AA, section BB, side and end view of the foam elements arranged in position.
Figure 5B:
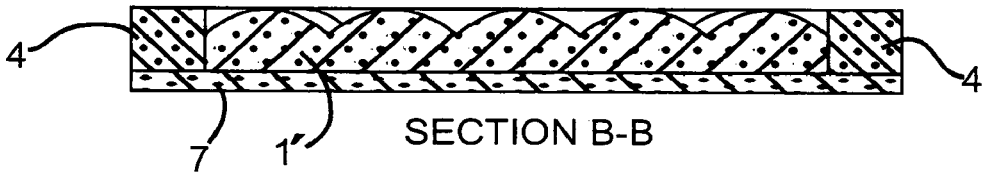
Figure 9:
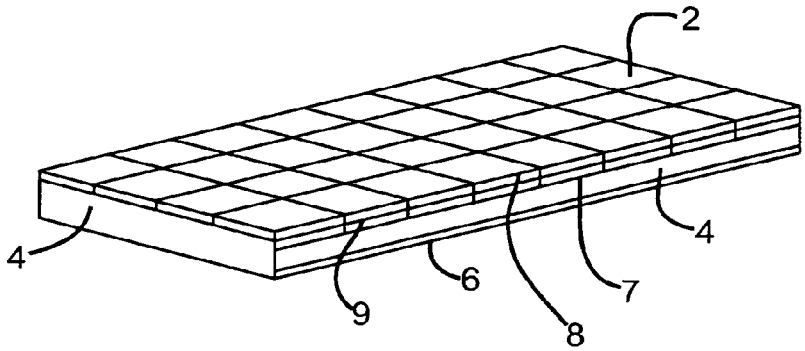
FIG. 9 shows a perspective view of the fiber pad(s) on the mattress.

FIG. 1 shows a partial cutaway perspective view, and FIG. 4 shows an exploded view, of the exemplary mattress design. FIG. 4 shows an exploded view of the mattress design. The illustrated mattress is an elongated mattress, and extends along a longitudinal axis. The longitudinal axis of the illustrated mattress extends from a head end 1' (shown in FIG. 4) to a heel section 5. A set of tubular foam elements 1 are provided on a dense foam bottom 6 (not shown in FIG. 1). The illustrated tubular elements have a diameter and a perpendicular length dimension. The illustrated tubular foam elements 1 are disposed with the length dimension extending along the longitudinal axis. The tubular foam elements 1 are inside of a firm foam surround 4 formed of four sides bonded together. On top of the foam elements 1 are full foam layer 7 and partial foam layer 8 and corresponding partial fibrous fill layer 9 and full fibrous fill layer 2, for example Triline Medical LLC "Trifill" or Fossfill® Supreme. The sloped heel section 5 provides heel pressure relief. A low shear upper surface 3, which is fluid proof, stain resistant, anti-bacterial and anti-fungal is zippered to the mattress, permitting replacement and cleaning. FIGS. 3A, 3B and 3C show, respectively, a top, side and end view of the mattress, showing in dotted lines the various sections of the mattress and their respective foam elements 1. FIGS. 5A, 5B, 5C, 5D and 5E show, respectively, a top, section AA, section BB, side and end view of the foam elements arranged in position. FIG. 9 shows a perspective view of the fiber pad(s) on the mattress, which are bonded to the firm foam surround 4.

Figure 7A:
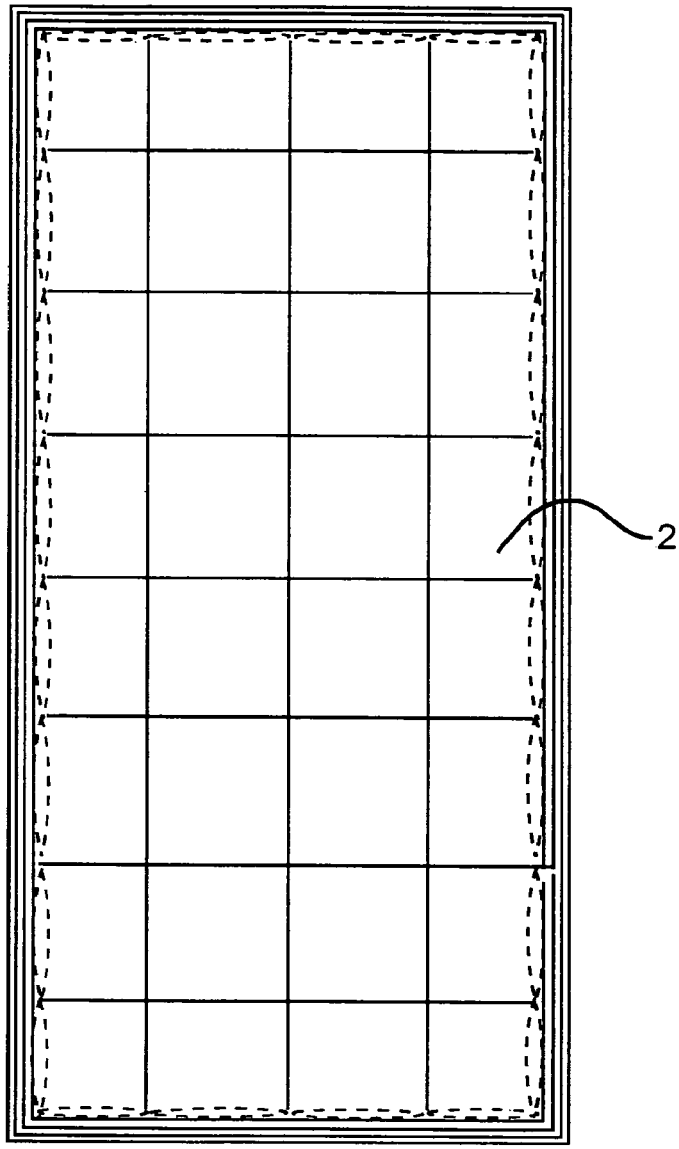
FIGS. 7A, 7B and 7C show, respectively, a top, side and end view of a full fiber layer.
Figure 7B:
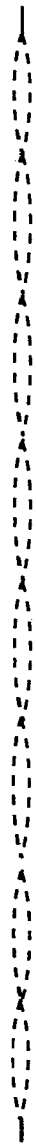
Figure 7C:
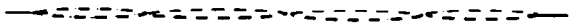
Figure 8A:
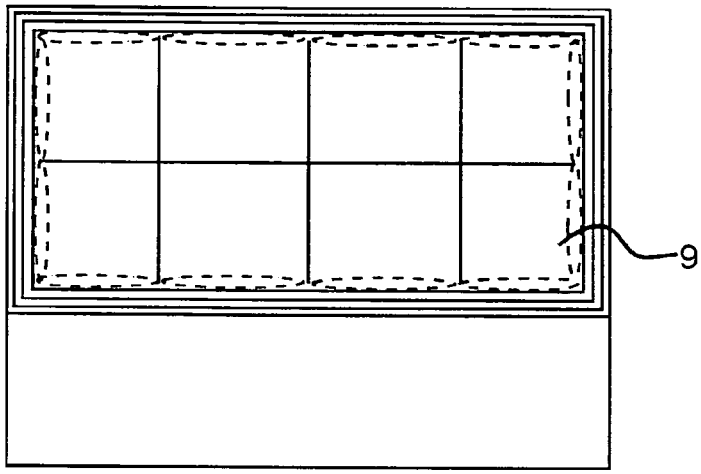
FIGS. 8A, 8B and 8C show a top, side and end view of a partial fiber layer.
Figure 8B:
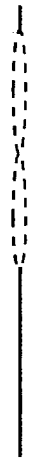
Figure 8C:
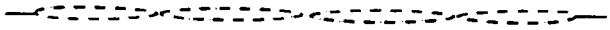

FIGS. 7A, 7B and 7C show, respectively, a top, side and end view of the full fiber layer 2. FIGS. 8A, 8B and 8C show a top, side and end view of the partial fiber layer 9. The fill layers are, for example, navy stretch interlock fabric with Fossfill® Supreme filling. At the head portion of the mattress, the partial foam layer 8 is absent and the partial fibrous fill layer 9 is present.

Figure 6:
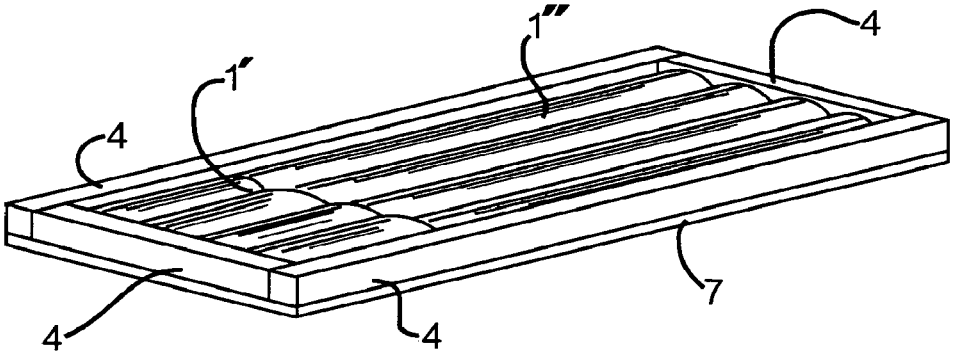
FIG. 6 shows a perspective view of the foam elements in the mattress of FIGS. 5A-5E.
Figure 5C:
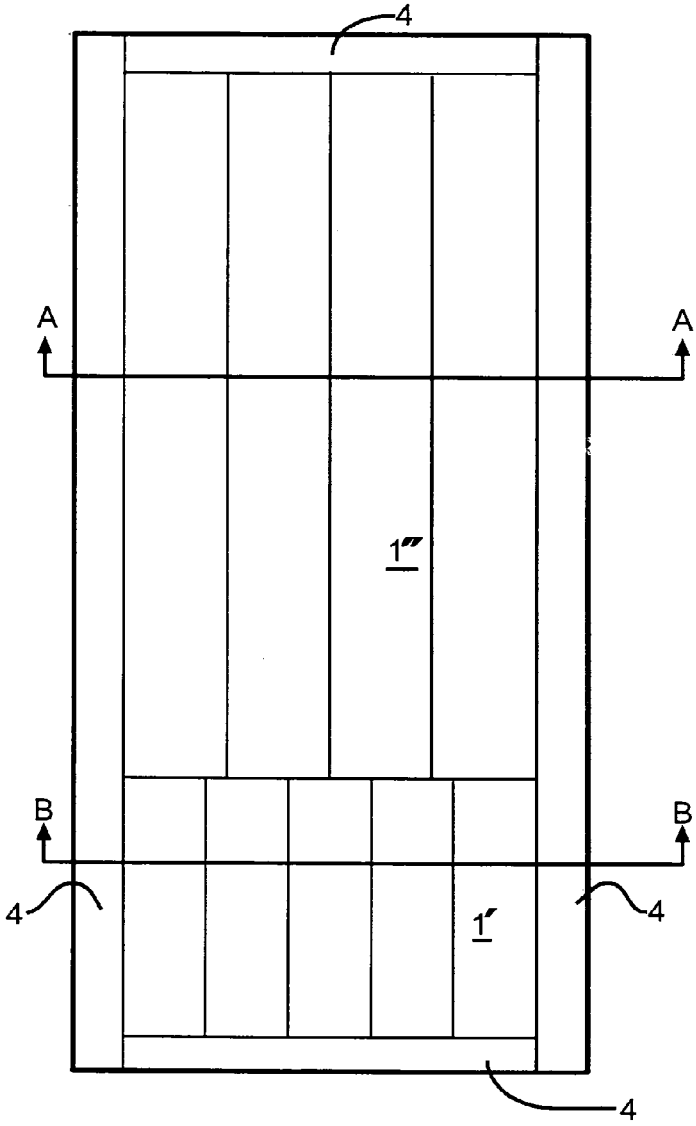
Figure 5D:
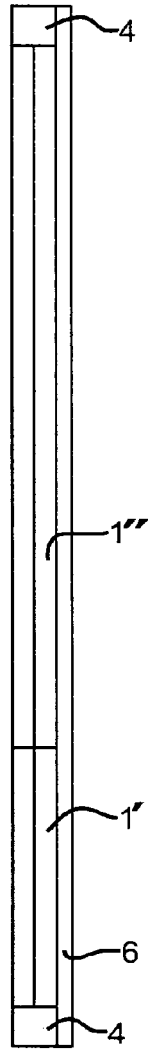
Figure 5E:
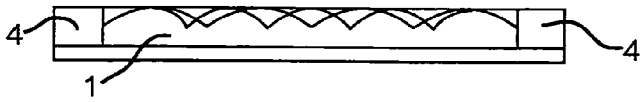

FIG. 6 shows a perspective view of the foam elements in the mattress of FIGS. 5A-5E. The foam elements at the head end 1' and body section 1" are preferably 2.3 HR 23 ILD, with respectively different element radii. The firm foam surround is preferably 1.8 LD 55 ILD, the foam bottom 6 preferably 1" thick 1.4 Lb 44 ILD. The full and partial foam layers 7, 8 are preferably each 1" thick 2.3 HR 23 ILD.

The foam bottom 6 is preferably supported in an Integrity 30 Fire Barrier, cut to fit 80"×36"×7", sewn closed on the ends.

Figure 2:
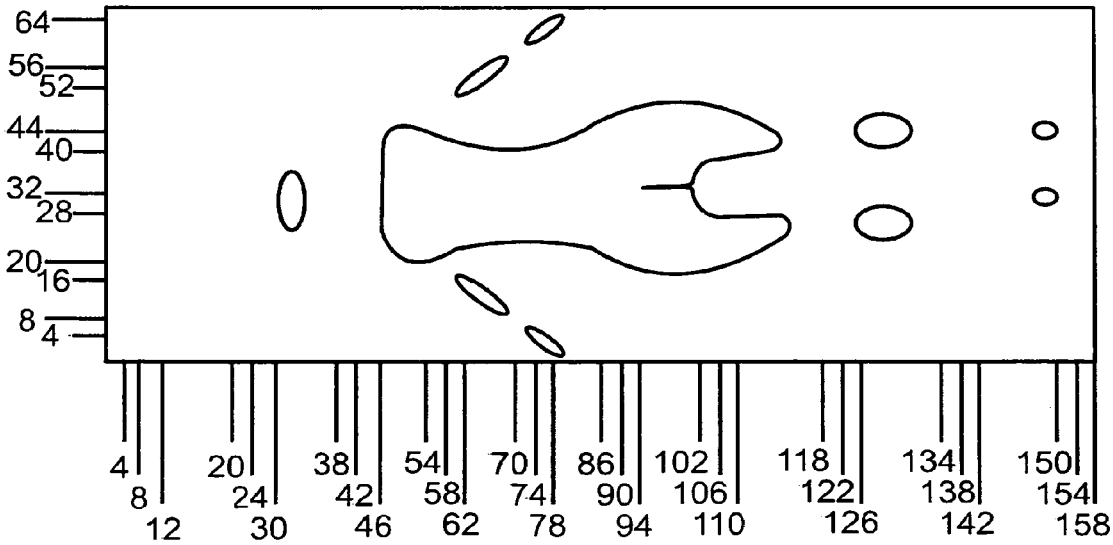
FIG. 2 shows the relatively uniform pressure distribution, as measured using an XSensor X2 pressure assessment tool, of the mattress according to FIG. 1.

FIG. 2 shows the relatively uniform pressure distribution, as measured using an XSensor X2 pressure assessment tool, of the mattress according to FIG. 1. As shown in FIG. 2, the pressure distribution of the back and buttocks is well distributed and relatively even, and pressure extremes are not seen at the head, arms and legs.

Figure 10A:
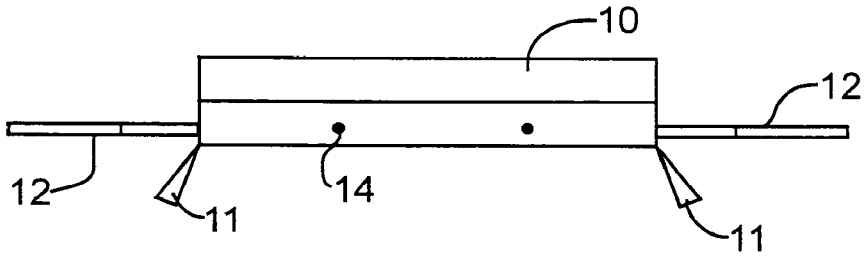
FIGS. 10A, 10B, and 10C show an end, top, and side view of a mattress cover, including hold-down loops.
Figure 10B:
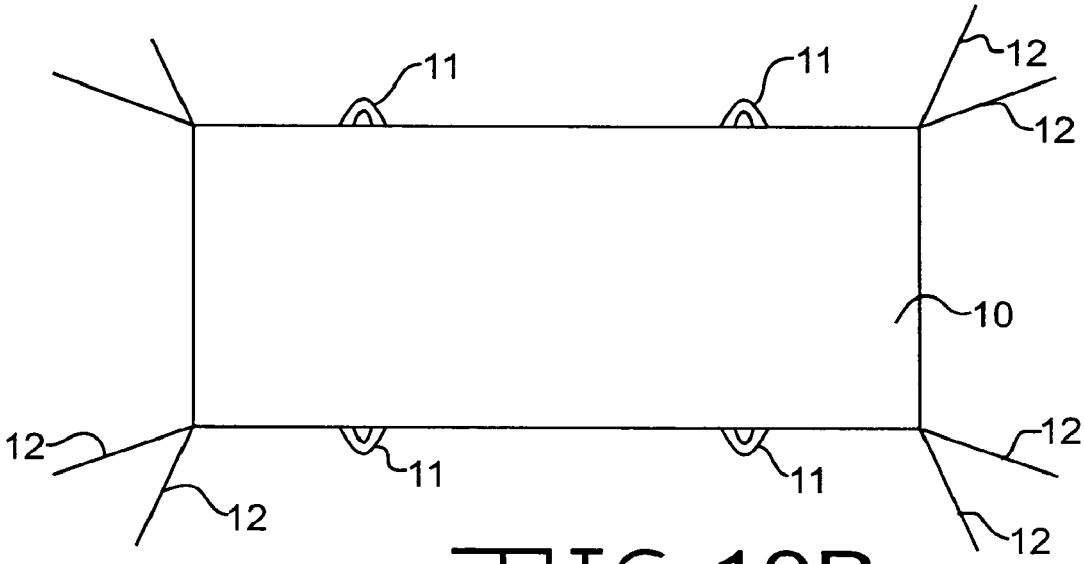
Figure 10C:
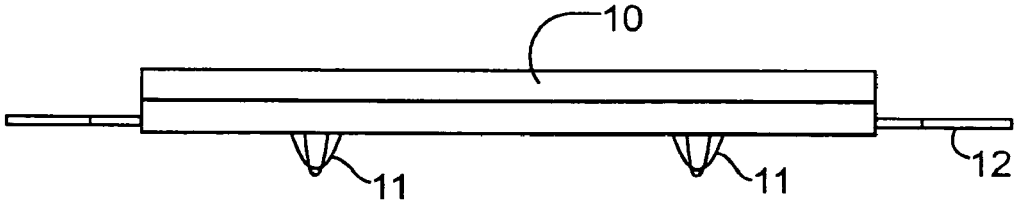
Figure 11A:
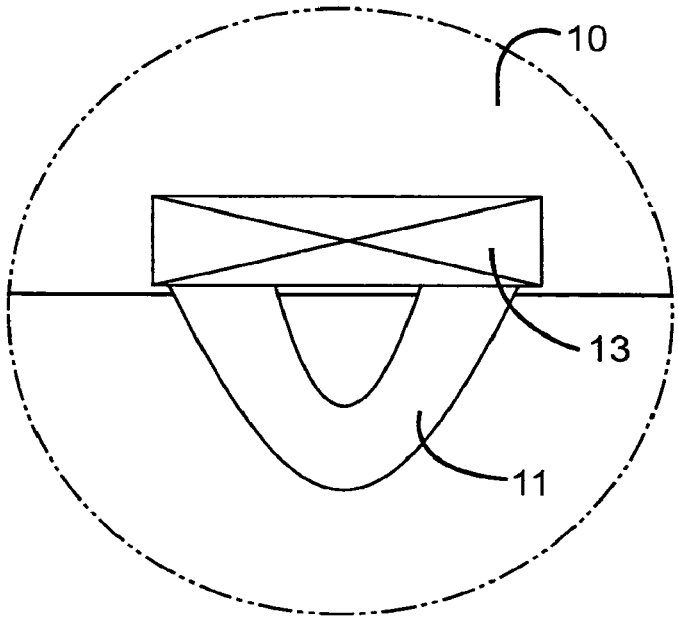
FIGS. 11A, 11B and 11C show a perspective view of the mattress cover and details of a cover and hold-down loop, respectively.
Figure 11B:
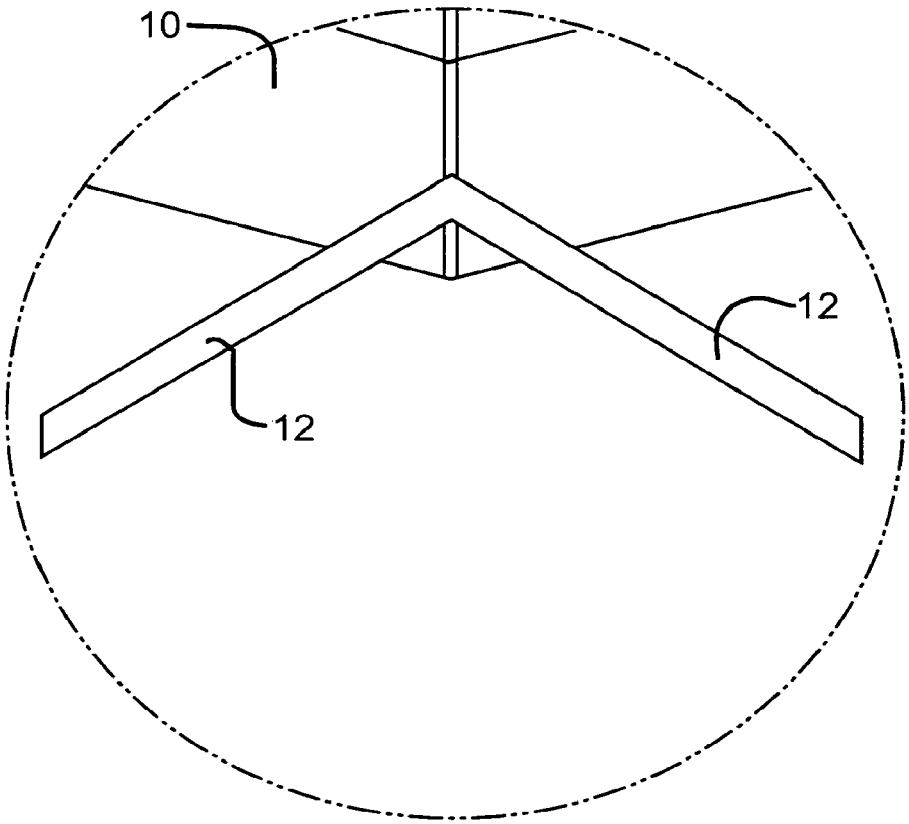
Figure 11C:
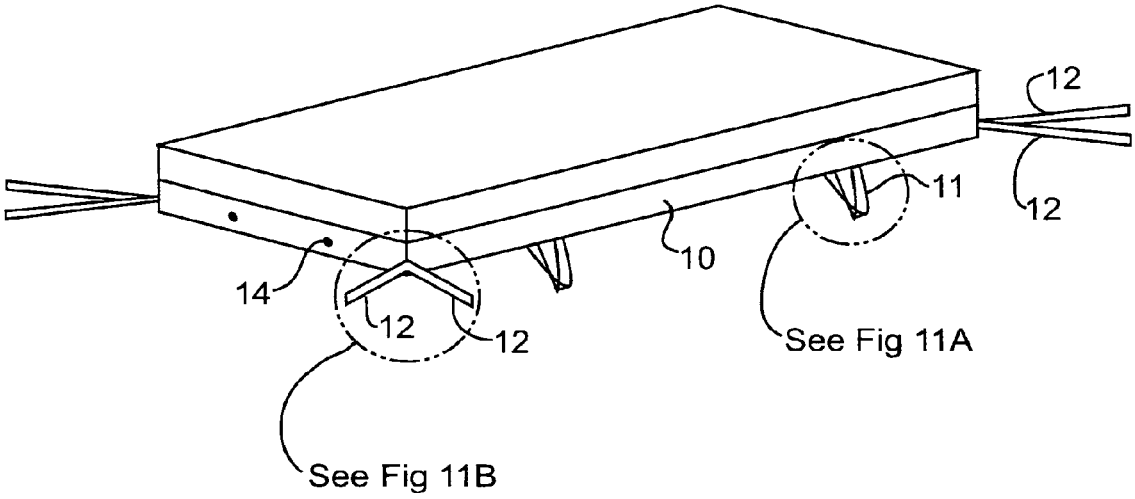

FIGS. 10A, 10B, and 10C show an end, top and side view of a mattress cover 10, including hold-down loops 11 (two per lateral side) and corner web extensions 12 (two per corner). FIG. 11A shows an isometric view of the mattress cover 10, while FIGS. 11A and 11B show details of a corner web extension 12 cover and hold-down loop 11, which is reinforced with a webbing strip 13, respectively. Vent holes 14 are provided in the cover 10 to avoid ballooning.

The present invention therefore provides a simple passive patient support system which is simple in construction, readily manufactured using known techniques, and which provides enhanced patient comfort and therapy.

According to the exemplary mattress design, the patient is supported by foam elements, with a pressure equalization layer which is preferably a non-woven fibrous material fill layer. Pressure measurements of this design show superior performance over traditional designs. Optionally, a firm foam surround is provided to support a person sitting at the edge of the mattress and to avoid a tendency to roll out of bed.

The exemplary mattress design is also applicable to non-medical mattresses and other ergonomic support surfaces, such as beds, couches, chairs, lounges, and the like.

Although the invention is illustrated and described herein as embodied in a foam mattress, it is nevertheless not intended to be limited to the details shown, since various modifications and structural changes may be made therein without departing from the spirit of the invention and within the scope and range of equivalents of the claims.

What is claimed is:

1. An elongated mattress, extending along a longitudinal axis, the mattress comprising: a base, a plurality of zones disposed longitudinally with respect to the longitudinal axis, each zone comprising a set of foam elements, each element having a length dimension extending along the longitudinal axis, said elements tapering such that corresponding surfaces of the elements are adjacent at a first height and separated in space at a second height, said second height surfaces each forming a substantially continuous elongate surface extending along the longitudinal axis, and a fibrous pad on top of the foam elements, wherein a weight of a person lying on top of the pad is evenly distributed without substantial pressure concentrations due to the mattress configuration, and wherein each zone has a separately controlled compliance.

2. The mattress according to claim 1, further comprising at least one foam layer between said foam elements and said fibrous pad.

3. The mattress according to claim 1, further comprising a dense foam edge surrounding an edge of the sets of foam elements, to provide support for a person sitting at said edge.

4. The mattress according to claim 1, having a head end and a foot end, wherein said foot end is sloped to provide heel pressure relief.

5. The mattress according to claim 1, wherein said fibrous pad comprises a synthetic polymer fiber.

6. The mattress according to claim 1, wherein said fibrous pad comprises a synthetic fiber sandwiched between two sheets, said sheets being periodically sewn to maintain the fiber within predefined regions of said fibrous pad.

7. An elongated mattress extending along a longitudinal axis, the mattress comprising: a foam bottom supporting a plurality of zones that are arranged in longitudinal series, a plurality of elongate solid foam elements having a length dimension extending along the longitudinal axis having a hemi-cylindrical cross-sectional shape arranged in at least one of said zones to support a part of a human body, and a foam surround establishing a perimeter around said plurality of zones.

8. The mattress according to claim 7, wherein said foam surround comprises a plurality of foam surround sections, said plurality of foam surround sections being bonded together, said plurality of foam surround sections further being bonded to said foam bottom.

9. The mattress according to claim 8 wherein a foam cover engages said foam surround and at least a portion of said foam elements.

10. The mattress according to claim 9 wherein said foam cover extends over said foam surround and said foam elements, and wherein a partial foam layer engages said foam cover.

11. The mattress according to claim 10 wherein a fiber layer covers said partial foam layer and at least a portion of said foam cover.

12. The mattress according to claim 10 wherein a mattress cover encloses said foam bottom, said foam surround, said cover having at least one vent hole.

13. An elongated mattress extending along a longitudinal axis, the mattress comprising: a foam bottom, a plurality of foam surround sections, at least one elongated, substantially hemi-cylindrical solid foam element having a length dimension extending along the longitudinal axis and adjacent to at least one of said plurality of foam surround sections, and a foam cover, said foam cover extending over said plurality of foam surround sections and said at least one elongated, substantially hemi-cylindrical element.

14. The mattress of claim 13 wherein said plurality of foam surround sections are bonded together as a perimeter.

15. The mattress of claim 14 wherein said at least one elongated, substantially hemi-cylindrical element is one of a plurality of elongated, substantially hemi-cylindrical elements, and said foam bottom is bonded to said foam surround and further bonded to said plurality of elongated, substantially hemi-cylindrical elements.

16. The mattress of claim 15 wherein a foam cover extends over bonded portions of said foam bottom, said foam surround, and said plurality of elongated, substantially hemi-cylindrical elements, a mattress cover envelopes said foam cover, said foam bottom, said foam surround, and said plurality of elongated, substantially hemi-cylindrical elements, said mattress cover further including at least one hold-down loop.

17. The mattress of claim 16 wherein said mattress cover includes a vent and at least one corner web extension.

18. The mattress of claim 17 wherein said at least one corner web extension includes a corner web extension attached to each of four corners of said mattress cover.

19. A mattress, comprising a foam bottom, a foam surround on top of said bottom, a plurality of elongate solid foam elements on top of said bottom and inside said surround, said elements having a hemi-cylindrical cross-sectional shape tapering such that corresponding surfaces of said elements are adjacent at a first height and separated in space at a second height, said second height surfaces forming a substantially continuous elongate surface, said foam elements comprising head end foam elements and heel section foam elements separate from said head end foam elements, said head end foam elements and said heel section foam elements defining zones each having a separately controlled compliance, a full foam layer on top of said head end foam elements, said heel section foam elements and said surround, a partial foam layer on top of said full foam layer over said head end foam elements, a partial fiber layer on top of said full foam layer over said heel section foam elements, and a full fiber layer on top of the partial foam layer and the partial fiber layer, wherein a weight of a person lying on top of the pad is evenly distributed without substantial pressure concentrations due to the mattress configuration.

20. The mattress according to claim 19 wherein a mattress cover encloses said foam bottom, said foam surround, said foam elements and said foam and fiber layers, said cover having at least one vent hole.

* * * * *